US007463841B2

(12) United States Patent
Okamoto

(10) Patent No.: US 7,463,841 B2
(45) Date of Patent: Dec. 9, 2008

(54) HEATING DEVICE, FUSER DEVICE, AND IMAGE FORMING APPARATUS INCLUDING POWER SUPPLY DEVICES FOR SUPPLYING POWER TO A HEATING UNIT

(75) Inventor: Masami Okamoto, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 372 days.

(21) Appl. No.: 11/283,828

(22) Filed: Nov. 22, 2005

(65) Prior Publication Data

US 2006/0133846 A1 Jun. 22, 2006

(30) Foreign Application Priority Data

Nov. 26, 2004 (JP) ..... 2004-341445

(51) Int. Cl.
*G03G 15/00* (2006.01)
*G03G 15/20* (2006.01)

(52) U.S. Cl. ..... 399/67; 399/69; 399/88

(58) Field of Classification Search ..... 399/67, 399/69, 70, 88, 90
See application file for complete search history.

(56) References Cited

U.S. PATENT DOCUMENTS 6,542,705 B2 * 4/2003 Fujita et al. ..... 399/69
7,130,555 B2 * 10/2006 Kishi et al. ..... 399/69
7,209,675 B2 * 4/2007 Matsusaka et al. ..... 399/88
7,257,341 B2 * 8/2007 Hanamoto et al. ..... 399/67
2004/0202490 A1 10/2004 Okamoto
2004/0245241 A1 12/2004 Kishi et al.
2004/0247332 A1 12/2004 Kishi et al.
2004/0258426 A1 12/2004 Kishi et al.
2005/0123315 A1 6/2005 Kishi et al.
2005/0139584 A1 6/2005 Kishi et al.
2005/0175368 A1 8/2005 Matsusaka et al.
2005/0175370 A1 8/2005 Matsusaka et al.
2005/0191078 A1 9/2005 Kishi et al.

FOREIGN PATENT DOCUMENTS

JP 2000-75737 3/2000
JP 2002-184554 6/2002
JP 2004-117468 4/2004

OTHER PUBLICATIONS

U.S. Appl. No. 11/582,991, filed Oct. 19, 2006, Kishi et al.

* cited by examiner

*Primary Examiner*—William J. Royer
(74) *Attorney, Agent, or Firm*—Oblon, Spivak, McClelland, Maier & Neustadt, P.C.

(57) ABSTRACT

A heating device includes a heating unit, a main power supply device configured to supply an electric power to the heating unit from an external power supply, an auxiliary power supply device configured to be chargeable by use of the external power supply, and a charger configured to charge the auxiliary power supply device during formation of an image while neither the main power supply device nor the auxiliary power supply device is supplying an electric power to the heating unit, such that a maximum limit of a charge amount of the auxiliary power supply device is set to a predetermined amount smaller than a full-charge amount of the auxiliary power supply device.

8 Claims, 3 Drawing Sheets

HEATING DEVICE, FUSER DEVICE, AND IMAGE FORMING APPARATUS INCLUDING POWER SUPPLY DEVICES FOR SUPPLYING POWER TO A HEATING UNIT

BACKGROUND OF THE INVENTION

1. Field of the Invention

The present invention generally relates to heating devices, fuser devices, and image forming apparatuses, and particularly relates to a fuser device which is provided with a main power supply device for supplying power from an external power supply and an auxiliary power supply device capable of charging electricity based on the external power supply, these power supply devices serving as power supply means for supplying power to a heating unit.

2. Description of the Related Art

Image forming apparatuses such as copier machines form images on recording media such as paper sheets or overhead projector sheets. As consideration is given to the speed, image quality, and cost of an image forming process, an electrophotographic system is typically employed. The electrophotographic system forms a toner image on a recording medium, and fuses the formed toner image with the recording medium by applying heat and pressure. As a fusing system, a heat roller system is most commonly used from the safety point of view. The heat roller system includes a heating roller for providing heat by use of a heating member such as a halogen heater, and includes a mutually pressuring unit called a nip unit in which a pressuring roller is situated to oppose the heating roller and pressed against the heating roller. A recording medium on to which a toner image is transferred is passed through the nip unit, thereby experiencing heat and pressure, which fuse the toner image on the recording medium.

In recent years, out of consideration for environmental issues, there has been an ongoing effort to reduce power consumption in image forming apparatuses such as copier machines and printer apparatuses. In order to reduce power consumption in image forming apparatuses, an effective measure is to lower the temperature of the heating unit such as a fusing roller and fusing belt provided in the fuser device during the period in which no paper sheet is traveling in the image forming apparatus (e.g., during the standby period).

When the temperature of the heating unit is lowered during a no-paper-sheet-travel period, the heating unit needs to return to a certain temperature prior to the subsequent use of the fuser device. The user thus needs to wait in the meantime. Since it takes time before the apparatus becomes usable, convenience regarding the use of the apparatus is not satisfactory. In order to avoid such inconvenience, it is conceivable to shorten the time period in which the temperature of the heating unit is increased by providing an auxiliary power from an auxiliary power supply apparatus. In consideration of this, reducing the heat capacity of the fusing roller is desired.

The fusing roller comes in contact with a transfer member, and its heat is thus deprived of at the time of image formation. As a result, the temperature of the surface of the fusing roller drops rapidly despite the large heat capacity of the fusing roller, resulting in temperature below the minimum temperature necessary to achieve satisfactory fusing performance. In consideration of this, an auxiliary power supply apparatus that can be charged may be provided in an image forming apparatus, and supplies an electric power to the heater at the time of image formation, thereby preventing the temperature of the surface of the fusing roller from dropping.

Patent Document 1 discloses a fuser device provided with a main power supply device and an auxiliary power supply device, the fuser device having a heating unit comprised of a main heat generating body and an auxiliary heat generating body, the main heat generating body receiving an electric power from the main power supply device, and the auxiliary heat generating body receiving an electric power from the auxiliary power supply device having a capacitor. When heating of the heating unit starts, a large electric power is supplied from the main power supply device and from the auxiliary power supply device simultaneously, thereby raising the temperature of the heating unit to a desired temperature in a short time. During the standby period, the heating unit does not receive an electric power.

[Patent Document 1] Japanese Patent Application Publication No. 2002-184554

In the related-art fuser device as described above, the auxiliary power supply device is not charged by the external power supply at the time of image formation. There is thus a need to charge the auxiliary power supply device after the forming of one image before the forming of the next image. This results in an inconvenience in that a waiting period before the next image is formed is prolonged due to the time required for electric charge.

Further, during the forming of an image, the pressuring roller inside the fuser device is sufficiently heated. If the auxiliary power supply device is charged to its full capacity, and is then allowed to discharge for the purpose of heating, the heating unit ends up providing excessive heat to the transfer member and toner. This creates a risk of causing a failure such as the blocking of the toner and transfer member after the forming of the image.

Accordingly, there is a need for a heating device, a fuser device, and an image forming apparatus in which a time period between an image formation and the next image formation can be shortened, and, also, excessive heating of the heating unit can be prevented.

SUMMARY OF THE INVENTION

It is a general object of the present invention to provide a heating device, a fuser device, and an image forming apparatus that substantially obviate one or more problems caused by the limitations and disadvantages of the related art.

Features and advantages of the present invention will be presented in the description which follows, and in part will become apparent from the description and the accompanying drawings, or may be learned by practice of the invention according to the teachings provided in the description. Objects as well as other features and advantages of the present invention will be realized and attained by a heating device, a fuser device, and an image forming apparatus particularly pointed out in the specification in such full, clear, concise, and exact terms as to enable a person having ordinary skill in the art to practice the invention.

To achieve these and other advantages in accordance with the purpose of the invention, the invention provides a heating device that includes a heating unit, a main power supply device configured to supply an electric power to said heating unit from an external power supply, an auxiliary power supply device configured to be chargeable by use of the external power supply, and a charger configured to charge said auxiliary power supply device during formation of an image while neither said main power supply device nor said auxiliary power supply device is supplying an electric power to said heating unit, such that a maximum limit of a charge amount of said auxiliary power supply device is set to a predetermined amount smaller than a full-charge amount of said auxiliary power supply device.

According to another aspect of the present invention, a fuser device for use in an image forming apparatus includes a fusing roller, a heating unit embedded in said fusing roller, a main power supply device configured to supply an electric power to said heating unit from an external power supply, an auxiliary power supply device configured to be chargeable by use of the external power supply, and a charger configured to charge said auxiliary power supply device during formation of an image while neither said main power supply device nor said auxiliary power supply device is supplying an electric power to said heating unit, such that a maximum limit of a charge amount of said auxiliary power supply device is set to a predetermined amount smaller than a full-charge amount of said auxiliary power supply device.

According to another aspect of the present invention, an image forming apparatus includes a unit configured to form a toner image by use of an electrophotographic system, and a fuser device configured to heat and fuse the toner image with a recording medium, wherein said fuser device include a fusing roller, a heating unit embedded in said fusing roller, a main power supply device configured to supply an electric power to said heating unit from an external power supply, an auxiliary power supply device configured to be chargeable by use of the external power supply, and a charger configured to charge said auxiliary power supply device during formation of an image while neither said main power supply device nor said auxiliary power supply device is supplying an electric power to said heating unit, such that a maximum limit of a charge amount of said auxiliary power supply device is set to a predetermined amount smaller than a full-charge amount of said auxiliary power supply device.

According to at least one embodiment of the heating device, the fuser device, and the image forming apparatus of the present invention, the time required to charge the auxiliary power supply device before the forming of a next image is shortened, and the heating unit can avoid applying excessive heat to a transfer member and toner.

BRIEF DESCRIPTION OF THE DRAWINGS

Other objects and further features of the present invention will be apparent from the following detailed description when read in conjunction with the accompanying drawings, in which.

DESCRIPTION OF THE PREFERRED EMBODIMENTS

In the following, embodiments of the present invention will be described with reference to the accompanying drawings.

Figure 1:
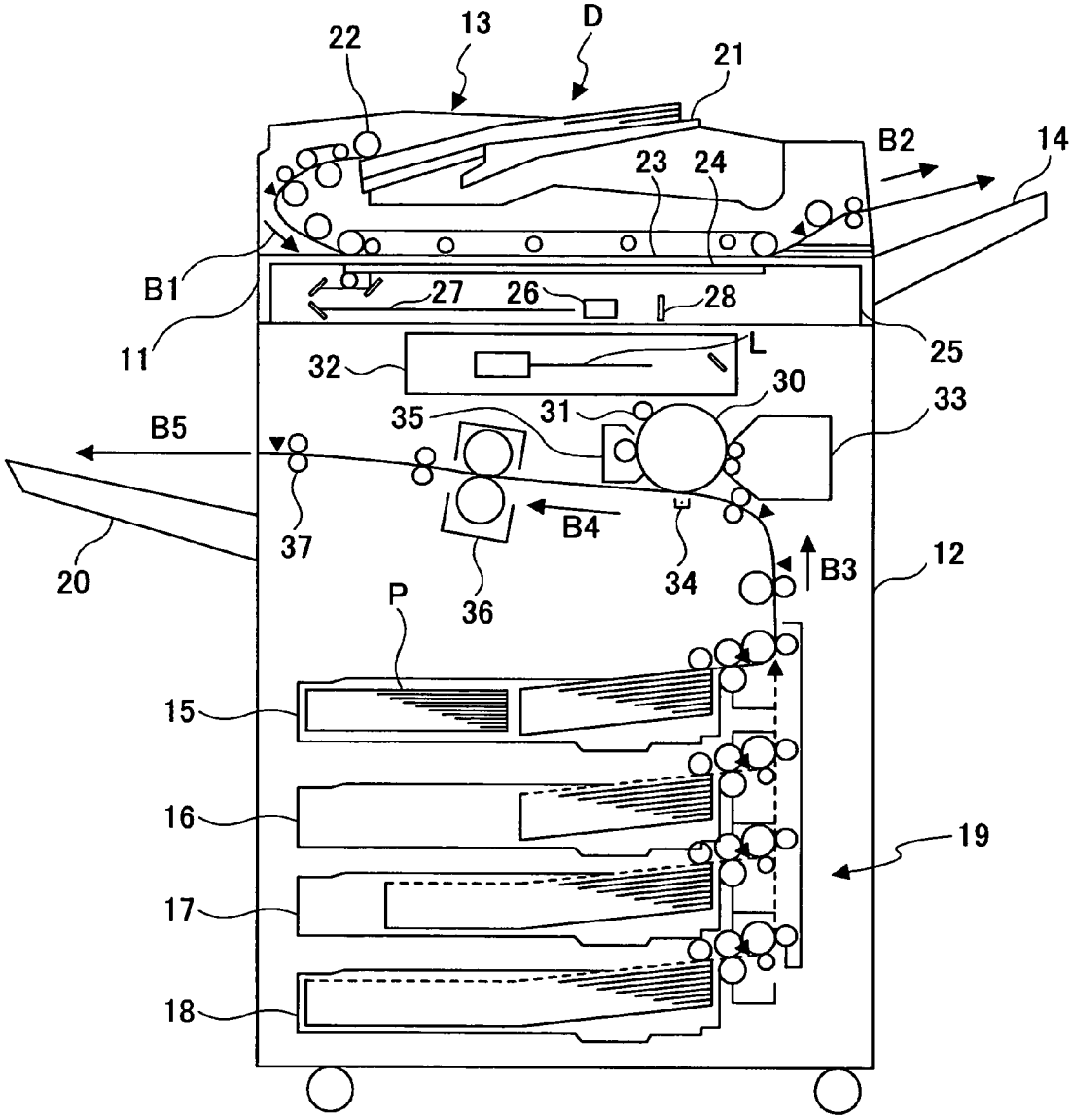
FIG. 1 is a cross-sectional schematic view of an image forming apparatus such as a copier machine or a printer apparatus based on the electrophotography system according to the present invention.

FIG. 1 is a cross-sectional schematic view of an image forming apparatus such as a copier machine or a printer apparatus based on the electrophotography system according to the present invention. The image forming apparatus according to this embodiment is capable of processing 100 sheets continuously (75 CPM (CPM: copy speed)), for example, and mainly includes a scan unit 11 for scanning a document, an image forming unit 12 for forming an image, an auto-document feeder 13, a document ejection tray 14 for keeping a stack of documents ejected from the auto-document feeder 13, a sheet supply unit 19 having sheet supply cassettes 15 through 18, and a sheet ejection tray 20 for keeping a stack of the recorded sheets. The auto-document feeder 13 may be capable of loading 100 sheets at the maximum, and the scan unit 11 may require 60 seconds to scan 100 sheets of documents.

A document D is set on a document platform 21 of the auto-document feeder 13, and an operation on an operation unit (not shown) such as the pressing of a print key is performed. In response, the sheet at the top of the document D is slid out in a direction B1 through the rotation of a pickup roller 22, and is carried and placed on a contact glass 24 fixed in the scan unit 11 through the rotation of a document conveyor belt 23. An image of the document D placed on the contact glass 24 is scanned by a scan device 25 that is situated between the image forming unit 12 and the contact glass 24. The scan device 25 includes a light source 26 for illuminating the document D on the contact glass 24, an optical system 27 for focusing the document image, and a photoelectric conversion device 28 such as a CCD on which the document image is focused. After the scanning of the image, the document D is carried in a direction B2 through the rotation of the document conveyor belt 23 so as to be ejected on to the document ejection tray 14. In this manner, the document D is carried and placed one sheet after another on the contact glass 24, and the scan unit 11 scans the document images.

Inside the image forming unit 12, a photoconductor 30 serving as an image carrier is provided. The photoconductor 30 rotates clockwise in FIG. 1. A charger 31 charges the surface of the photoconductor 30 to a predetermined potential. A write unit 32 shines a laser beam L modulated in response to image information indicative of the image scanned by the scan device 25. The laser light L illuminates the charged surface of the photoconductor 30, thereby forming a latent electrostatic image on the surface of the photoconductor 30. This latent electrostatic image passes through a developing device 33, and is transferred by a transfer device 34 on to a transfer member (recording medium) P that is supplied to a space between the photoconductor 30 and the transfer device 34. The surface of the photoconductor 30 is cleaned by a cleaner 35 after the transfer of the toner image.

The sheet supply cassettes 15 through 18 provided at the bottom of the image forming unit 12 accommodate a recording medium P such as paper sheets. The recording medium P is slid out in a direction B3 from one of the sheet supply cassettes 15 through 18. The toner image formed on the surface of the photoconductor 30 as described above is transferred on to the surface of the recording medium P. The recording medium P then passes through a fuser device 36 provided inside the image forming unit 12 as indicated by an arrow B4. Heat and pressure is applied to fuse the transferred toner image with the surface of the recording medium P. The recording medium P having passed through the fuser device 36 is carried by a pair of ejection rollers 37 and ejected as indicated by an arrow B5, thereby being placed on the sheet ejection tray 20.

Figure 2:
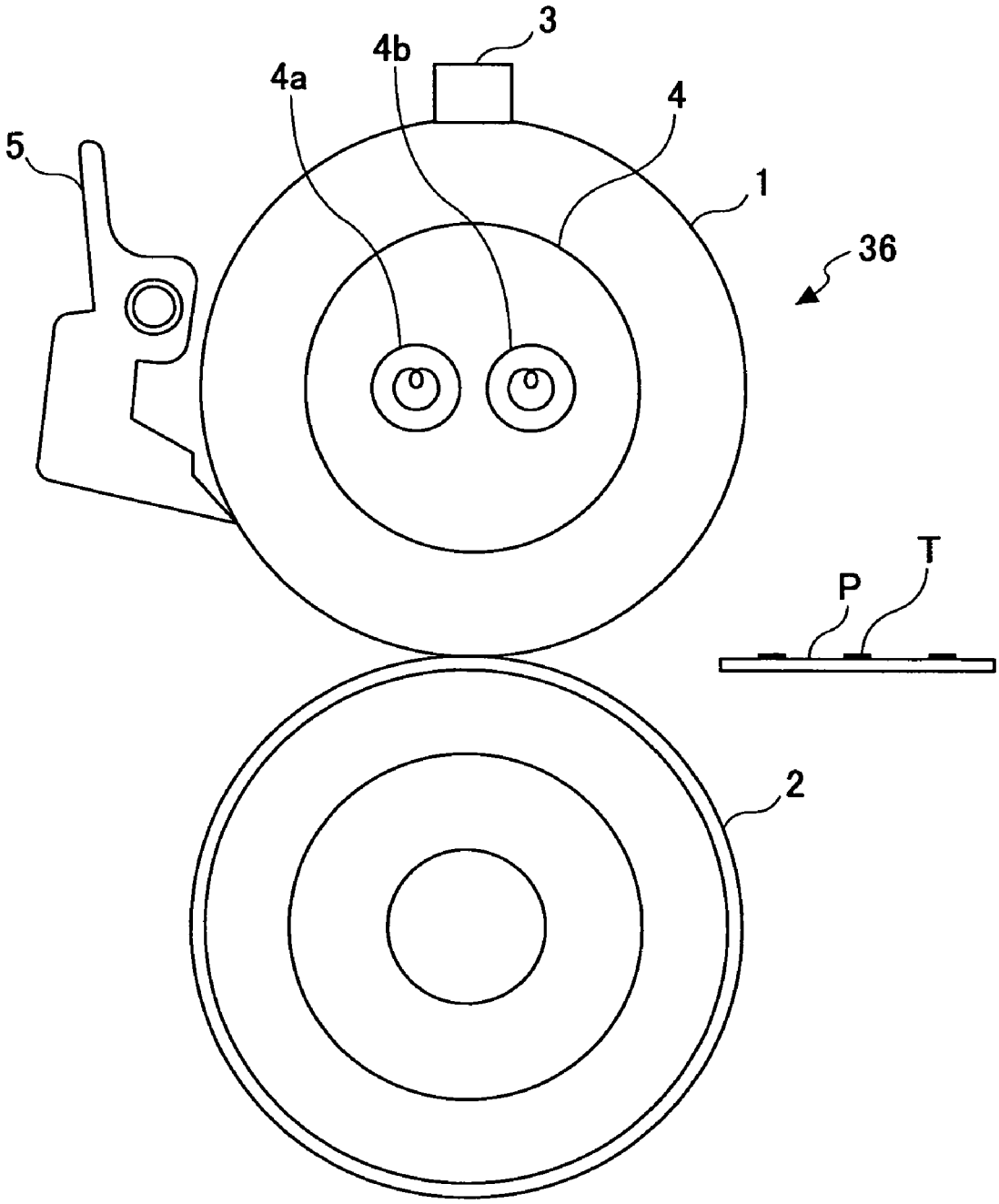
FIG. 2 is a front view of a fuser device according to the present invention.
Figure 3:
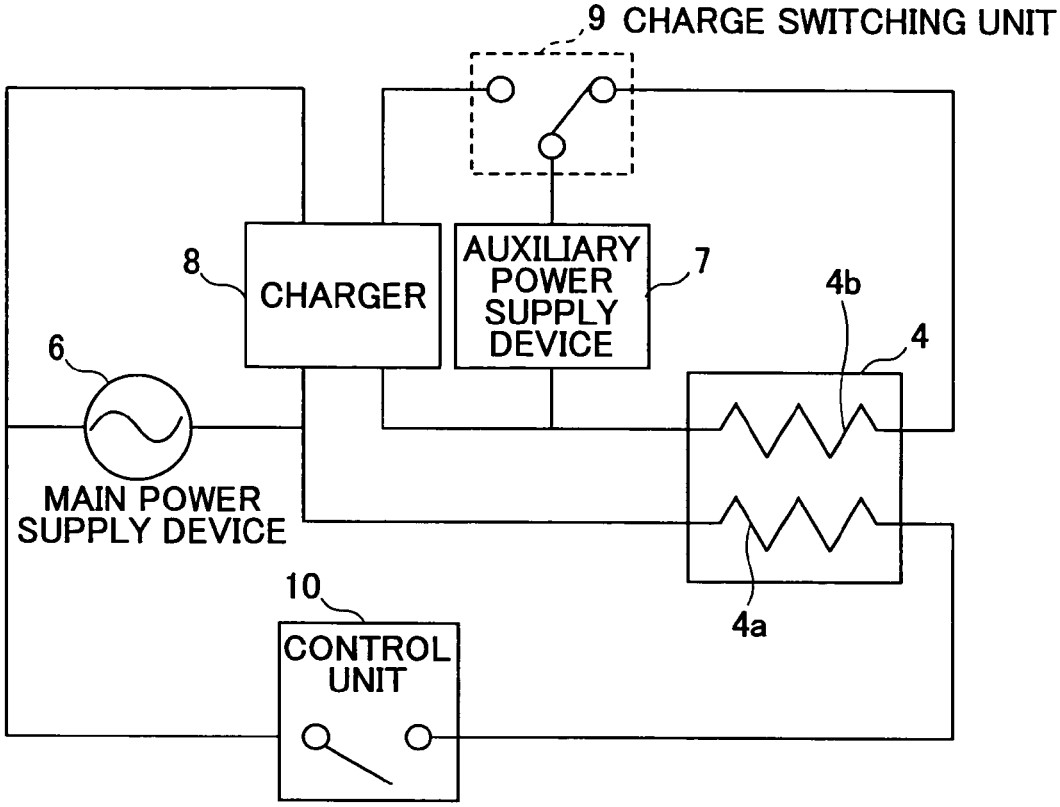
FIG. 3 is a block diagram showing the configuration of a heat generating device according to the present invention.

In the following, a description will be given of the fuser device 36 according to an embodiment of the present invention. FIG. 2 is a front view of the fuser device 36 according to the present invention. FIG. 3 is a block diagram showing the configuration of a heat generating device according to the present invention.

In this example, the fuser device 36 includes a fusing roller 1, a pressuring roller 2 pressed against the fusing roller 1, and a fuse separating nail 5 pressed against the fusing roller 1 with a predetermined pressure. Further, the fuser device 36 includes a heating unit 4, a main power supply device 6 for supplying an electric power from an external power supply (commercial power supply), and an auxiliary power supply device 7 that is chargeable by use of the external power supply. The heating unit 4 is embedded inside the fusing roller 1. The heating unit 4 includes a main heating unit 4*a* receiving an electric power from the main power supply device 6 and an auxiliary heating unit 4*b* receiving an electric power from the auxiliary power supply device 7. These heating units 4*a*,4*b* are implemented by use of halogen heaters or the like.

The fusing roller 1 is provided with a temperature detecting unit 3 such as a thermistor. A control unit 10 of the image forming apparatus controls the switch-on/off of the main heating unit 4*a* and the auxiliary heating unit 4*b* so as to control the temperature of the surface of the pressuring roller 2. With the fuser device 36 having the configuration as described above, a yet-to-be-fused image of toner T formed on the transfer member P is heated and melted, so that the toner T is fused with the transfer member P.

The main power supply device 6 is connected to a commercial power supply via a plug or the like. As shown in FIG. 3, the auxiliary power supply device 7 is configured to be chargeable through a charger 8. In the heating unit 4 of this example, the main heating unit 4*a* receives an electric power from the main power supply device 6, and the auxiliary heating unit 4*b* receives an electric power from the auxiliary power supply device 7. Switching is performed under the control of the charger 8 by operating the switches provided in a charge switching unit 9 and a control unit 10.

With this configuration, the main power supply device 6 supplies an electric power to the main heating unit 4*a*, and the auxiliary power supply device 7 supplies an electric power to the auxiliary heating unit 4*b*. This provides for an electric power exceeding the maximum power supply capacity of the main power supply device 6 to be supplied to the fuser device 36 for a predetermined time period.

In this example, the charger 8 charges the auxiliary power supply device 7 during the forming of an image while the main power supply device 6 is not supplying an electric power to the heating unit 4, and neither is the auxiliary power supply device 7 supplying an electric power to the auxiliary heating unit 4*b*. Namely, the charger 8 charges the auxiliary power supply device 7 while the heating units 4*a* and 4*b* are switched-off without the temperature of the surface of the fusing roller 1 dropping.

The full-charge amount (in terms of voltage) of the auxiliary power supply device 7 is denoted as V0, the power of the heater immediately following a discharge from the fully-charged state denoted as W0, the maximum limit of a charge amount during the forming of an image denoted as V1, and the power of the heating unit 4 immediately following a discharge from the maximum charge limit denoted as W1. In this example, provision is made such that the charger 8 performs charging to satisfy the following relationship.

$$V0>V1,\ W0>W1$$

In this example, thus, the maximum limit of a charge amount of the auxiliary power supply device 7 is set smaller than the full-charge amount of the auxiliary power supply device 7, thereby shortening the time required for electric charge. As a result, the time required to charge the auxiliary power supply device 7 before the forming of the next image can be shortened. Further, the amount of an electric discharge is also suppressed, thereby preventing excessive heat from being applied to a transfer member and toner. This can avoid a failure such as the blocking of the toner and transfer member following the forming of an image.

In this example, further, the charger 8 is configured such that the maximum limit of a charge amount of the auxiliary power supply device 7 is set to V0 during the times other than the time of image formation. This ensures that the amount of power supply from the auxiliary power supply device 7 to the heating unit 4 is sufficient, thereby making it possible to avoid a fusing failure.

In this example, the auxiliary power supply device 7 is implemented as electric double-layer capacitors (condensers). This provides for a sufficient electric power to be supplied even if the charging time is as short as a few minutes. If a secondary battery such as a typical nickel-cadmium battery is used as the auxiliary power supply device 7, at least a few hours of rapid charging is necessary.

An electric double-layer capacitor has an almost infinite life, which is advantageous in comparison with a nickel-cadmium battery, which can only be charged and discharged 500 times to 1000 times. Another merit is that there is little degradation even after repeated charging and discharging.

In the embodiment described above, an electric double-layer capacitor is used as the auxiliary power supply device 7. The auxiliary power supply device 7 of the present invention is not limited to this example, and a battery that can be charged and discharged repeatedly may as well be used. As a heat generating member, a halogen heater is not a limiting example. A plate-shape heat generating member or a heat generating member utilizing the IH system may as well be used.

Further, the present invention is not limited to these embodiments, but various variations and modifications may be made without departing from the scope of the present invention.

The present application is based on Japanese priority application No. 2004-341445 filed on Nov. 26, 2004, with the Japanese Patent Office, the entire contents of which are hereby incorporated by reference.

What is claimed is:

1. A heating device, comprising:

a heating unit;

a main power supply device configured to supply an electric power to said heating unit from an external power supply;

an auxiliary power supply device configured to be chargeable by use of the external power supply; and a charger configured to charge said auxiliary power supply device during formation of an image while said main power supply device is not supplying an electric power to said heating unit.

2. A fuser device for use in an image forming apparatus, comprising:

a fusing roller;

a heating unit configured to heat said fusing roller;

a main power supply device configured to supply an electric power to said heating unit from an external power supply;

an auxiliary power supply device configured to be chargeable by use of the external power supply; and a charger configured to charge said auxiliary power supply device during formation of an image while said main power supply device is not supplying an electric power to said heating unit.

3. An image forming apparatus, comprising:

a fuser device configured to fuse a toner image with a recording medium; wherein said fuser device includes:

a main power supply device configured to supply an electric power to said fuser device from an external power supply; and an auxiliary power supply device configured to be chargeable by a charger by use of the external power supply, wherein the charger is configured to charge said auxiliary power supply device during formation of an image by the image forming apparatus while said main power supply device is not supplying an electric power to said fuser device.

4. The image forming apparatus as claimed in claim 3, wherein said auxiliary power supply device includes an electric double-layer capacitor.

5. The image forming apparatus as claimed in claim 3, wherein said fuser device includes:

a main heating unit configured to receive an electric power from said main power supply device; and an auxiliary heating unit configured to receive an electric power from said auxiliary power supply device.

6. The image forming apparatus as claimed in claim 3, wherein the auxiliary power supply device is not supplying an electric power to the fuser device when the charger charges the auxiliary power supply device.

7. The image forming apparatus as claimed in claim 3, wherein the charger is configured to charge said auxiliary power supply device during formation of an image by the image forming apparatus while said main power supply device is not supplying an electric power to said fuser device, such that a maximum limit of a charge amount of said auxiliary power supply device is set to a predetermined amount smaller than a full-charge amount of said auxiliary power supply device.

8. The image forming apparatus as claimed in claim 7, wherein said charger sets a maximum limit of a charge amount of said auxiliary power supply device to the full-charge amount during times other than a time of forming an image.

* * * * *